US005978991A

United States Patent [19]

Miles

[11] Patent Number: 5,978,991

[45] Date of Patent: Nov. 9, 1999

[54] DEVICE FOR RELIEVING WEIGHT OF A BLANKET ON FEET AND SUPPORTING FEET OF PARALYZED PERSONS

[76] Inventor: William J. Miles, 803 S. Lolita St., West Covina, Calif. 91791

[21] Appl. No.: 09/192,467

[22] Filed: Nov. 16, 1998

[51] Int. Cl.[6] ..... A47C 20/02

[52] U.S. Cl. ..... 5/651; 5/504.1

[58] Field of Search ..... 5/651, 504.1, 505.1, 5/506.1

[56] References Cited

U.S. PATENT DOCUMENTS

| | | | |
|---|---|---|---|
| 931,908 | 8/1909 | Weld | 5/621 |
| 2,465,781 | 3/1949 | Banta | 5/651 X |
| 2,646,578 | 7/1953 | Evans | 5/651 |
| 2,986,747 | 6/1961 | Posey | 5/645 |
| 5,101,526 | 4/1992 | Smith | 5/651 |

OTHER PUBLICATIONS

Dr. Leonard's America Leading Discount Healthcare Catalog, pp. 55, item entitled "Blanket Support"(Date Unknown).

*Primary Examiner*—Terry Lee Melius
*Assistant Examiner*—James M. Hewitt

[57] ABSTRACT

Device for relieving weight of a blanket on feet and supporting feet of persons suffering from paralysis of legs and feet is disclosed. The device comprises a board attached to a mattress in a way that a blanket can be placed over such board, thus relieving the pressure from feet, and channels attached to the board permitting to place feet in the channels and maintain feet in the upright position. The device also allows to adjust position of legs by adjusting of the angle of inclination of the channels with respect to the board.

1 Claim, 1 Drawing Sheet

DEVICE FOR RELIEVING WEIGHT OF A BLANKET ON FEET AND SUPPORTING FEET OF PARALYZED PERSONS

BACKGROUND OF THE INVENTION

This invention relates to a device for relieving weight of a blanket on feet and supporting feet of persons suffering from paralysis of legs and feet, as well as other illnesses such as multiple sclerosis. Pressure of a blanket or cover on feet and toes may seam trivial to healthy people, however, persons knowledgeable in the pertinent arts will recognize that pressure of a blanket or cover applied to feet or toes during hours of immobility (as is the case with the persons suffering from paralysis) causes extreme pain and suffering often overlooked even by doctors and hospitals. This invention permits a blanket or cover to be raised off feet and toes and thus relieve pressure of a blanket or cover applied to feet and toes. This invention further permits paralyzed individuals to maintain their feet in upright position and to adjust position of legs. Further, this invention allows to place feet against a firm surface thus easing pressure on tendons.

OVERVIEW OF THE PRIOR ART

Prior art attempts to solve the problem of pressure of a blanket or cover on feet and toes by using a wire frame extending outwardly from the surface of the bed and raising a blanket or cover off feet. Such wire frame is attached to a bed by inserting a portion thereof between a mattress and box spring. The shortcoming of such solution is that it lacks means of permitting paralyzed individuals to maintain their feet in upright position and to adjust position of legs. Also, it does not allow to place feet against a firm surface. Another shortcoming of the prior art is that it lacks means of attachment to a mattress but merely slides under a mattress, making it unstable.

SUMMARY OF THE INVENTION

It appears that a clear need exists for a device for relieving weight of a blanket on feet of persons suffering from paralysis of legs and feet which also permits paralyzed individuals to maintain their feet in upright position, adjust position of legs and place feet against a firm surface. The present invention satisfies this need.

The present invention comprises a board for placement of a blanket over the board, means of attachment of the board to a mattress in a way that the board extends outwardly from the mattress, two foot retaining channels attached to the board by way of a connector comprising a spring which has one end fixedly attached to the board and another end fixedly attached to each of the foot retaining channels, means of adjustment adjustably mounted to the board and to each of the foot retaining channels to permit adjustment of the angle of inclination of the foot retainers with respect to the board.

DESCRIPTION OF THE DRAWINGS

The advantages of the present invention will become better understood with reference to the following description of preferred embodiments of the invention, appended claims, and accompanying drawing figures in which the same reference numeral indicates the same feature, or features which are analogous in structure or function.

DESCRIPTION OF THE PREFERRED EMBODIMENT

Figure 1:
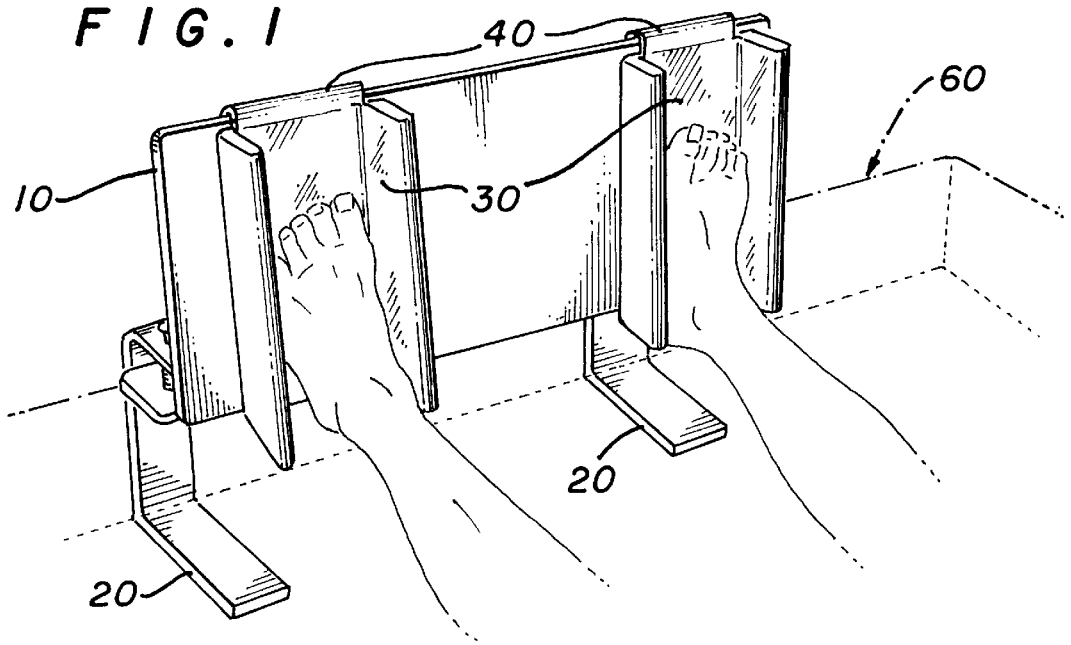
FIG. 1 is an isometric view of the preferred embodiment of this invention.

Referring to FIG. 1, numeral 10 indicates a Board, numeral 20 indicates a means of attachment, numeral 30 indicates a foot retaining channel, numeral 40 indicates a connector.

Figure 2:
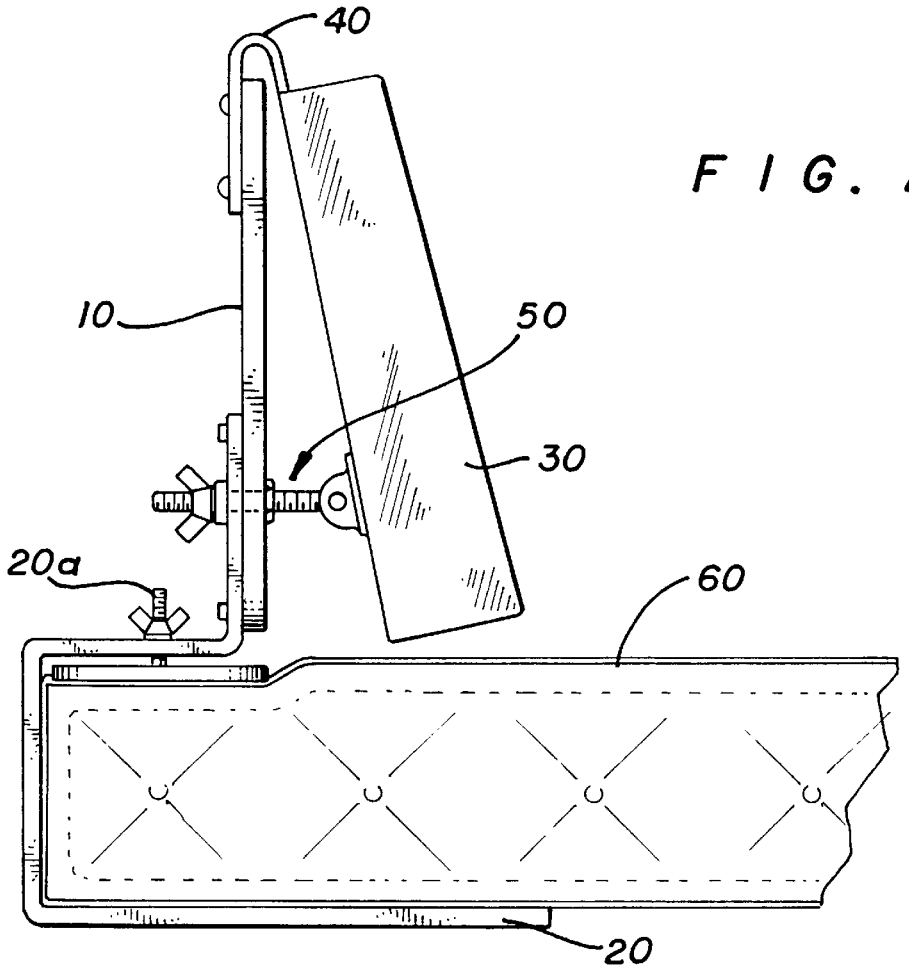
FIG. 2 is a side view of the preferred embodiment of this invention.

Referring now to FIG. 2, numeral 50 indicates a means of adjustment, numeral 20*a* indicates an externally threaded screw, numeral 60 indicates a mattress.

Referring now to both FIG. 1 and FIG. 2,

Board 10 is secured to mattress 60 by means of attachment 20 disposed on board 10. As persons knowledgeable in the pertinent arts will recognize, board 10 can be secured to mattress 60 by way of an externally threaded screw 20*a* threadedly received in an internally threaded bearing disposed in means of attachment 20. When so attached to mattress 60, board 10 extends outwardly from mattress 60.

Two foot retaining channels 30 are attached to board 10 by way of connector 40 so that openings of foot retaining channels 30 face feet. Connector 40 is comprised of a spring which has one end fixedly attached to board 10 and another end fixedly attached to each of foot retaining channels 30. Means of adjustment 50 are adjustably mounted to board 10 and to each of foot retaining channels 30 to permit adjustment of the angle of inclination of foot retaining channels 30 with respect to board 10. As should be apparent to persons knowledgeable in the pertinent arts, this can be accomplished by way of an externally threaded screw threadedly received in an internally threaded bearing disposed in board 10 and pivotally attached to connector 40. Upon rotation of such screw in either direction, connector 40 along with foot retaining channels 30 are caused to swing about the point of attachment of connector 40 to board 10 to a selected angularly adjusted position with respect to board 10.

A blanket is placed over board 10 thus relieving pressure of a blanket on feet. Feet are placed in foot retaining channels 30, which permits to maintain feet in a substantially upright position. Position of legs is adjusted by adjustment of the angle of inclination of foot retaining channels 30 with respect to board 10. foot retaining channels 30 may be covered with lambskin or similar material, as well as equipped with a heating element for further comfort means of adjustment 50 may be equipped with a means of automatically changing the angle of inclination.

The invention being thus described, it will be obvious to those knowledgeable in the pertinent arts that the invention may be modified in many ways. Such modifications are not to be regarded as a departure from the spirit and scope of the invention, and included within the scope of the following claims.

What is claimed is:

1. A device for relieving weight of a blanket on feet and supporting feet of paralyzed persons comprising:

(a) a board suitable for placement of a blanket over said board;

(b) means of attachment disposed on said board, said means of attachment suitable for attachment of said board to a mattress in a way that said board, when attached to the mattress, extends outwardly from the mattress so that a blanket placed over said board rests on said board without applying the weight of a blanket on feet;

(c) two foot retaining channels, each of said foot retaining channels form an opening facing a foot suitable for placing a foot inside the foot retaining channel so that a foot placed in said foot retaining channel is maintained in a substantially upright position, said foot retaining channels are attached to said board by way of connectors and form an angle of inclination with respect to said board;

(d) a spring which has one end fixedly attached to said board and another end fixedly attached to said foot retaining channel in a way permitting swinging movement of said foot retaining channel with respect to said board changing the angle of inclination of said foot retaining channel with respect to said board;

(e) means of adjustment adjustably mounted to said board and to said foot retaining channel to permit adjustment of the angle of inclination of said foot retaining channel with respect to said board.

* * * * *